US012398560B1

(12) United States Patent
Lee

(10) Patent No.: US 12,398,560 B1
(45) Date of Patent: Aug. 26, 2025

(54) CEILING PANEL MOUNTING SUPPORT STRUCTURE WITH IMPROVED MOUNTING STRUCTURE

(71) Applicant: Bang Woo Lee, Cheongju-si (KR)

(72) Inventor: Bang Woo Lee, Cheongju-si (KR)

( * ) Notice: Subject to any disclaimer, the term of this patent is extended or adjusted under 35 U.S.C. 154(b) by 0 days.

(21) Appl. No.: 19/059,414

(22) Filed: Feb. 21, 2025

(30) Foreign Application Priority Data

Feb. 22, 2024 (KR) ..... 10-2024-0025442

(51) Int. Cl.
*E04B 9/18* (2006.01)
*E04B 9/24* (2006.01)

(52) U.S. Cl.
CPC ..... *E04B 9/18* (2013.01); *E04B 9/241* (2013.01)

(58) Field of Classification Search
CPC ..... E04B 9/18; E04B 9/241
See application file for complete search history.

(56) References Cited

U.S. PATENT DOCUMENTS 6,367,757 B1 * 4/2002 Aramaki ..... F21V 21/38 248/327
7,341,232 B2 * 3/2008 Masas ..... E04B 9/18 248/65
9,255,402 B2 * 2/2016 Sareyka ..... F16M 13/027
11,459,753 B2 * 10/2022 McGee ..... F16L 3/22
11,821,205 B2 * 11/2023 McGee ..... E04B 9/064
2003/0222190 A1 * 12/2003 Masas ..... E04B 9/006 248/328
2015/0308617 A1 * 10/2015 Sareyka ..... F16M 13/027 52/506.07
2022/0064949 A1 * 3/2022 McGee ..... E04B 9/04
2022/0064950 A1 * 3/2022 McGee ..... E04B 9/241
2024/0229458 A1 * 7/2024 McGee ..... E04B 9/24

FOREIGN PATENT DOCUMENTS

EP 4375443 A1 * 5/2024 ..... E04B 9/18
JP 10-102669 A 4/1998
JP 2013-096193 A 5/2013
KR 200186256 Y1 6/2000
KR 100383793 B1 5/2003
KR 200328962 Y1 10/2003
KR 200375116 Y1 2/2005
KR 100572340 B1 4/2006
KR 100834861 B1 6/2008
(Continued)

OTHER PUBLICATIONS

Written Decision on Registration, issued on Nov. 13, 2024, in Korean Patent Application No. 10-2024-0025442.
(Continued)

*Primary Examiner* — Rodney Mintz
(74) *Attorney, Agent, or Firm* — Studebaker Brackett PLLC

(57) ABSTRACT

A ceiling panel mounting support structure with an improved mounting structure includes: an E-bracket 130 installed below a slab of a building, a turnbuckle 160 coupled to the E-bracket 130, and a ceiling panel hanger 180 including a pair of mounting portions 182 on both sides based on a center and coupled to the turnbuckle 160, wherein ceiling panels 120 arranged to be adjacent to each other are mounted on the pair of mounting portion 182 of the ceiling panel hanger 180.

2 Claims, 9 Drawing Sheets

(56) References Cited

FOREIGN PATENT DOCUMENTS

| | | | |
|---|---|---|---|
| KR | 20-2009-0002647 | U | 3/2009 |
| KR | 101613697 | B1 | 4/2016 |
| KR | 10-2018-0041035 | A | 4/2018 |
| KR | 101845356 | B1 | 4/2018 |
| KR | 200489137 | Y1 | 5/2019 |

OTHER PUBLICATIONS

Request for the Submission of an Opinion, issued on Jun. 20, 2024, in Korean Patent Application No. 10-2024-0025442.

* cited by examiner

CEILING PANEL MOUNTING SUPPORT STRUCTURE WITH IMPROVED MOUNTING STRUCTURE

CROSS-REFERENCE TO RELATED PATENT APPLICATION

This application claims the benefit of Korean Patent Application No. 10-2024-0025442, filed on Feb. 22, 2024, in the Korean Intellectual Property Office, the disclosure of which is incorporated herein in its entirety by reference.

BACKGROUND

1. Field

The present disclosure relates to a ceiling panel mounting support structure with improved mounting structure, and more particularly, to a ceiling panel mounting support structure capable of stably installing a ceiling panel on a bottom surface of a building slab, etc.

2. Description of Related Art

In general, pipes, ducts, and electrical wirings are installed in a branched manner below a slab, and ceiling panels are installed to prevent these from being exposed to the outside and to make them look aesthetically pleasing. That is, a plurality of ceiling panels are installed below the ceiling slab to finish the lower portion of the ceiling slab of a building, and items necessary for the building, such as lighting, are installed on the ceiling panels.

Here, a ceiling panel support structure that may stably install a plurality of ceiling panels by mounting them below the ceiling slab is required, and furthermore, a ceiling panel support structure with a further improved mounting structure is required.

RELATED ART DOCUMENT

Patent Document

Korean Patent No. 10-0834861 (registered on May 28, 2008)
Korean Patent No. 10-1613697 (registered on Apr. 12, 2016)
Korean Patent No. 10-0383793 (registered on Apr. 29, 2003)
Korean Utility Model No. 20-0186256 (registered on Apr. 7, 2000)

SUMMARY

An aspect of the present disclosure may provide a ceiling panel mounting support structure capable of stably installing a ceiling panel on a lower surface of a building slab, etc.

According to an aspect of the present disclosure, a ceiling panel mounting support structure with an improved mounting structure includes: an E-bracket 130 installed below a slab of a building, a turnbuckle 160 coupled to the E-bracket 130, and a ceiling panel hanger 180 including a pair of mounting portions 182 on both sides based on a center and coupled to the turnbuckle 160, wherein ceiling panels 120 arranged to be adjacent to each other are mounted on the pair of mounting portion 182 of the ceiling panel hanger 180.

The E-bracket 130 may include a vertical connecting bracket piece 132, an upper bracket piece 134 with a base portion coupled to one surface of the connecting bracket piece 132, a middle bracket piece 136, and a lower bracket piece 138 and having an E-shaped cross-section, the upper bracket piece 134 of the E-bracket 130 may be disposed on an upper surface of a lower beam piece 116 of an H beam 110 installed below the building slab, the middle bracket piece 136 may be fixed by an upper fixing bolt 136UFB so that the E-bracket 130 is fixedly installed to the H beam 110, a long bolt 140 may be coupled to the lower bracket piece 138 of the E-bracket 130, and an upper connecting nut 146 and a lower connecting nut 148 coupled to a threaded portion of an outer circumferential surface of the long bolt 140 may be respectively arranged on upper and lower surfaces of the lower bracket piece 138 of the E-bracket 130 so that the long bolt 140 is fixed to the lower bracket piece 138 of the E-bracket 130, the turnbuckle 160 may have a ring shape with a pair of left and right side buckle pieces 166 on an upper buckle piece 162 and a lower buckle piece 164, and the threaded portion of the outer circumferential surface of the long bolt 140 may be coupled to a buckle-side bolt 172 hole formed in the upper buckle piece 162 so that the turnbuckle 160 is coupled to the long bolt 140, an I-bolt 170 may be coupled to the lower buckle piece 164 of the turnbuckle 160, and the ceiling panel hanger 180 may be coupled to the I-bolt 170 by a bolt 172 and a nut 174.

The long bolt 140 may include an upper long bolt 142 having an upper end coupled to the lower bracket piece 138 of the E-bracket 130 and a lower end to which a pipe hanger 150 is coupled and a lower long bolt 144 coupled to a lower end of the pipe hanger 150, and an upper connecting nut 146 and a lower connecting nut 148 fastened to a threaded portion of an outer circumferential surface of the lower long bolt 144 may be respectively arranged on upper and lower surfaces of the lower bracket piece 138 of the E-bracket 130 so that the long bolt 140 is fixed to the lower bracket piece 138 of the E-bracket 130, the buckle-side bolt 172 hole formed in the upper buckle piece 162 of the turnbuckle 160 may be coupled to a threaded portion of an outer circumferential surface of the lower long bolt 144 so that the turnbuckle 160 is coupled to the lower long bolt 144, and the ceiling panels 120 may be installed by mounting the ceiling panels 120 adjacent to each other on a pair of the mounting portions 182 of the ceiling panel hanger 180.

The ceiling panel mounting support structure of the present disclosure has the effect of stably installing a plurality of ceiling panels by mounting them below a ceiling slab and has the effect of further improving the mounting structure of the ceiling panel. The present disclosure has the effect of reliably providing a ceiling panel mounting support structure with further improved mounting structure and stability, which enables stably installing a plurality of ceiling panels by mounting them below a ceiling slab.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, embodiments of the present disclosure will be described in detail with reference to the accompanying drawings. The objects, features, and advantages of the present disclosure will be more easily understood by referring to the accompanying drawings and the following detailed description. In describing exemplary embodiments of the present disclosure, a detailed description of known techniques associated with the present disclosure unnecessarily obscures the gist of the present disclosure, it is determined that the detailed description thereof will be omitted.

In describing elements of the present disclosure, the terms "first," "second," "A," "B," "(a)," and "(b)" may be used. These terms are merely for differentiating one element from another element, and the essence, number, order or sequence of a corresponding component should not be limited by the terms. Also, when an element or layer is described as being "connected" or "coupled" to another element or layer, the element or layer may be not only directly connected or coupled to that other element or layer, but may also be indirectly connected or coupled to the other element or layer with one or more intervening elements or layers therebetween.

Specific structures and functions in embodiments of the present disclosure are exemplified to illustrate embodiments according to the spirit of the present disclosure, and the embodiments according to the spirit of the present disclosure may be implemented in various forms and should not be construed as being limited to the embodiments described in this specification or application.

Figure 1:
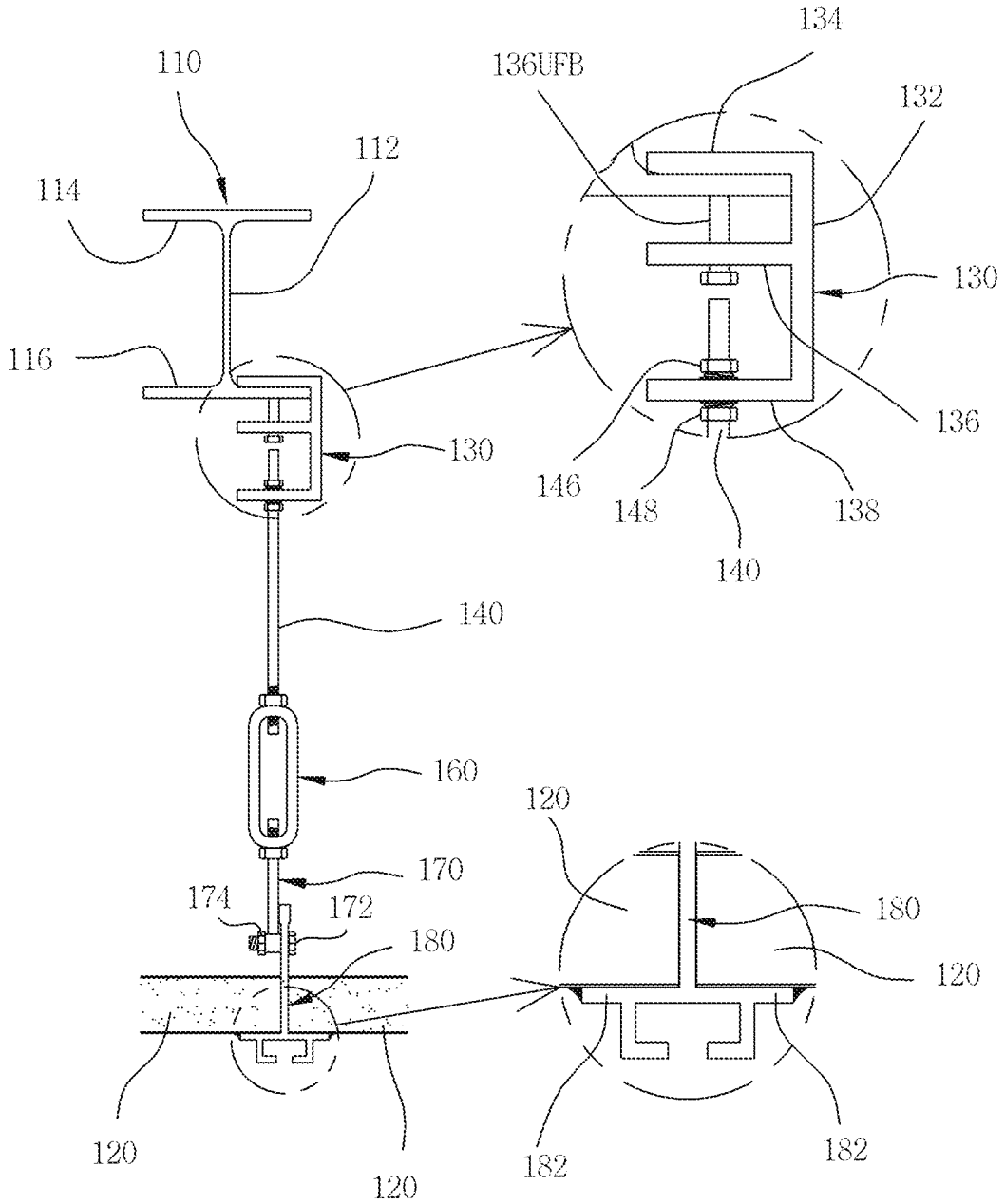
FIG. 1 is a front view schematically illustrating a state in which a ceiling panel is supported and installed by a ceiling panel mounting support structure with an improved mounting structure according to the present disclosure.
Figure 2:
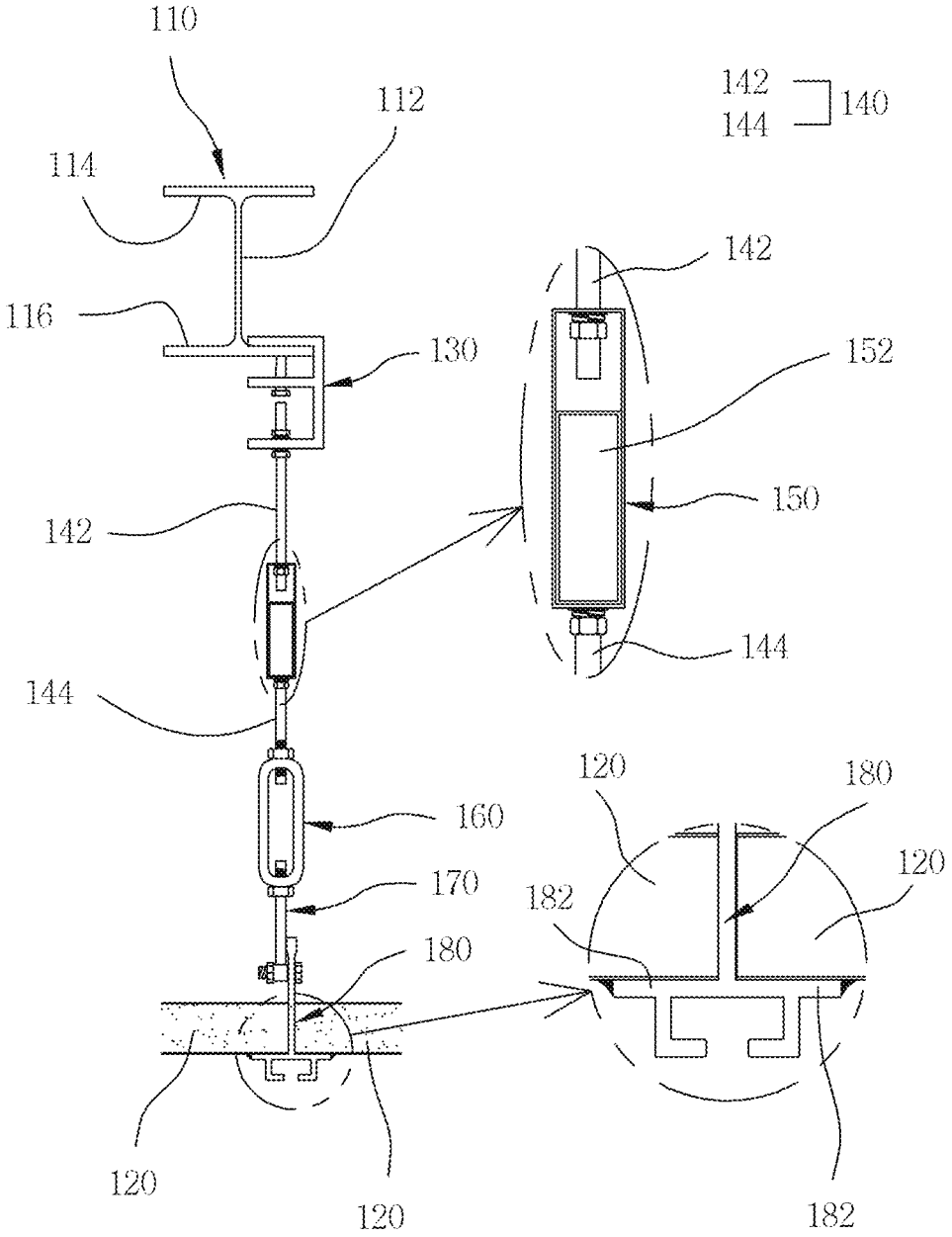
FIG. 2 is a front view schematically illustrating a state in which a ceiling panel is supported and installed by a ceiling panel mounting support structure with an improved mounting structure according to another embodiment of the present disclosure.
Figure 3:
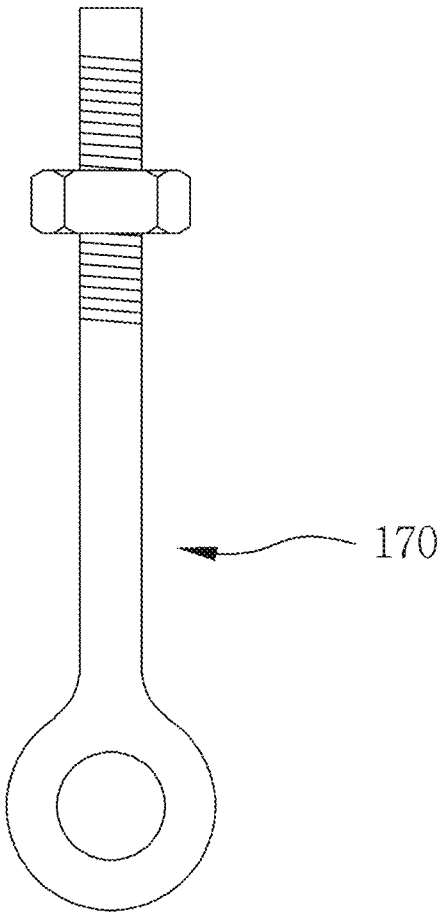
FIG. 3 is a side view of an I-bolt, which is a major part, illustrated in FIGS. 1 and 2.
Figure 4:
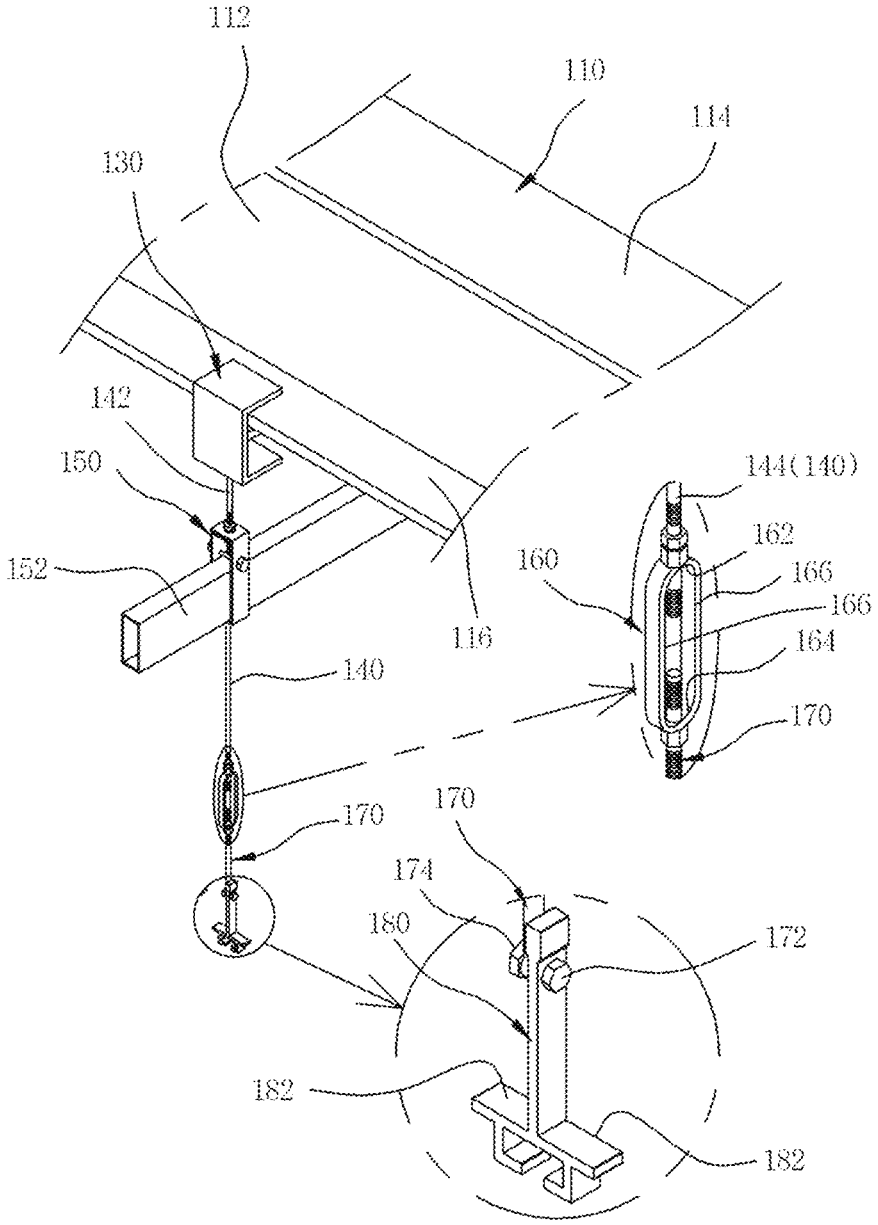
FIG. 4 is a perspective view illustrating a state in which a ceiling panel mounting support structure with an improved mounting structure according to the present disclosure is installed on an H beam below a building slab.
Figure 5:
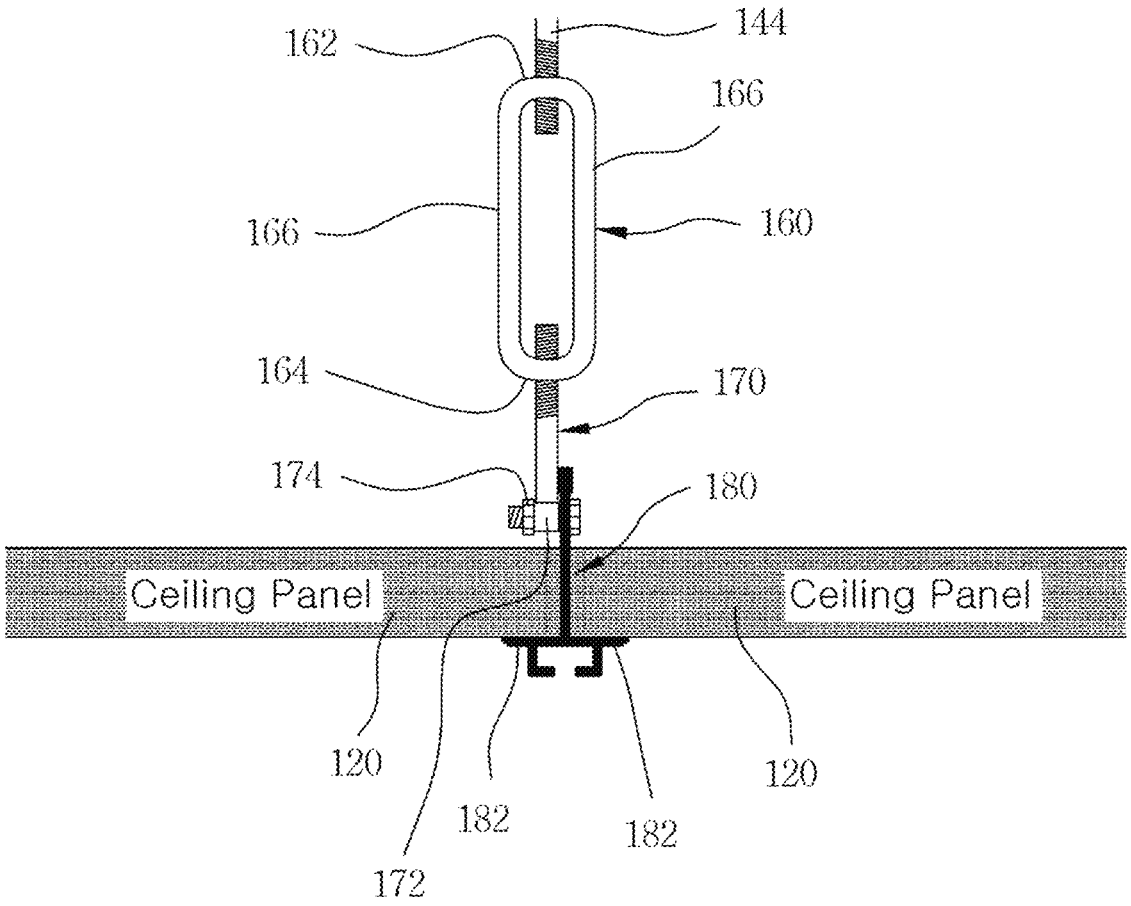
FIG. 5 is a front view illustrating an enlarged state in which a ceiling panel is installed by mounting the ceiling panel by a ceiling panel hanger illustrated in FIG. 2.
Figure 6:
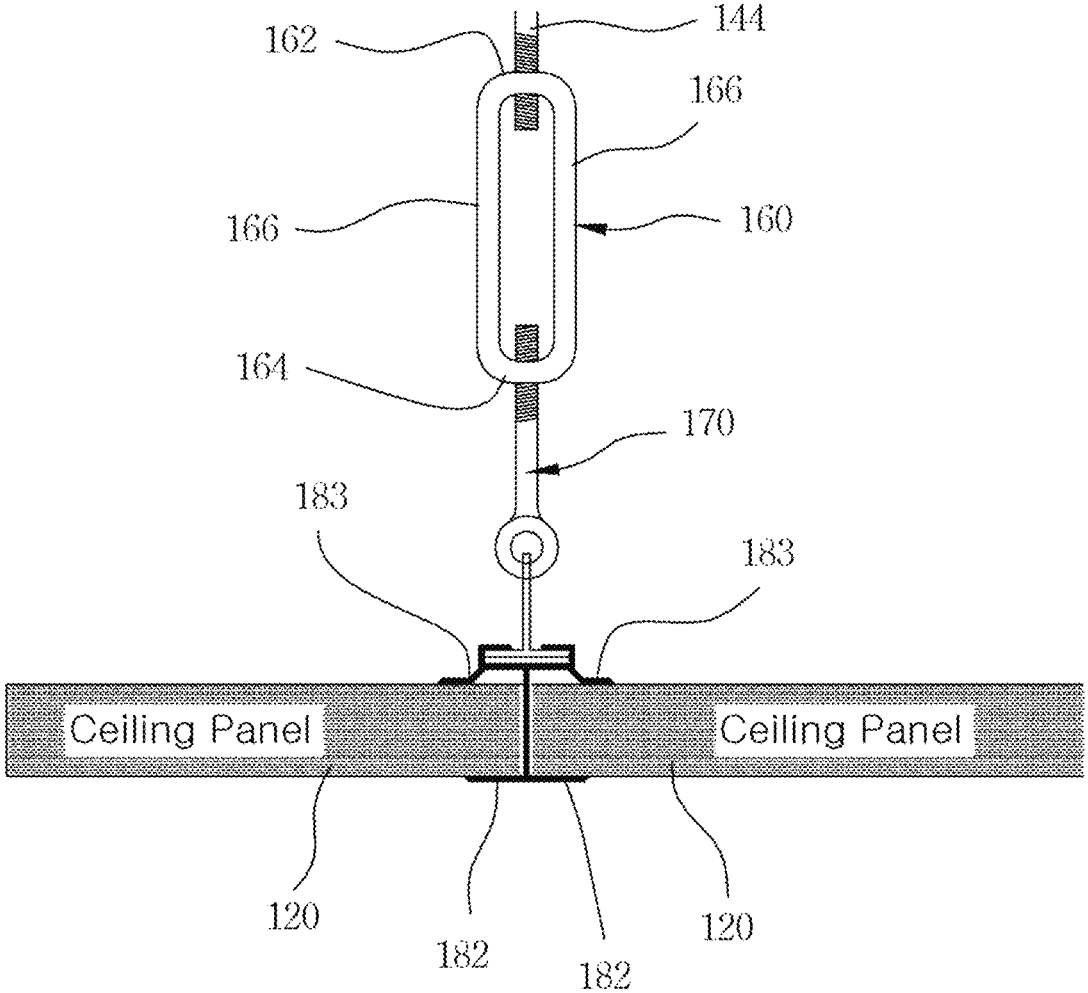
FIG. 6 is a side view schematically illustrating a modified embodiment of a ceiling panel hanger, which is a major portion of a ceiling panel mounting support structure with an improved mounting structure and an enlarged state in which a ceiling panel is mounted according to the present disclosure.

FIG. 1 is a front view schematically illustrating a state in which a ceiling panel is supported and installed by a ceiling panel mounting support structure with an improved mounting structure according to the present disclosure, FIG. 2 is a front view schematically illustrating a state in which a ceiling panel is supported and installed by a ceiling panel mounting support structure with an improved mounting structure according to another embodiment of the present disclosure, FIG. 3 is a side view of an I-bolt, which is a major part, illustrated in FIGS. 1 and 2, FIG. 4 is a perspective view illustrating a state in which a ceiling panel mounting support structure with an improved mounting structure according to the present disclosure is installed on an H beam below a building slab, FIG. 5 is a front view illustrating an enlarged state in which a ceiling panel is installed by mounting the ceiling panel by a ceiling panel hanger illustrated in FIG. 2, and FIG. 6 is a side view schematically illustrating a modified embodiment of a ceiling panel hanger, which is a major portion of a ceiling panel mounting support structure with an improved mounting structure and an enlarged state in which a ceiling panel is mounted according to the present disclosure.

Referring to the drawings, the ceiling panel mounting support structure with an improved mounting structure according to the present disclosure includes an E-bracket 130, a turnbuckle 160, and a ceiling panel hanger 180 as basic components.

Meanwhile, in another embodiment of the present disclosure, a long bolt 140, which is a main portion, includes an upper long bolt 142 and a lower long bolt 144, a pipe hanger 150 is coupled to the upper long bolt 142, the lower long bolt 144 is coupled to a lower end portion of the pipe hanger 150, the turnbuckle 160 is coupled to a lower end portion of the lower long bolt 144, and the ceiling panel hanger 180 may be coupled to the turnbuckle 160 via an I-bolt 170.

The E-bracket 130 is installed below a slab of a building.

The turnbuckle 160 is coupled to the E-bracket 130. The turnbuckle 160 is configured in a ring shape with an upper buckle piece 162 and a lower buckle piece 164 provided at upper and lower end portions of the left and right buckle bars, respectively.

The ceiling panel hanger 180 is coupled to the turnbuckle 160. The ceiling panel hanger 180 is provided with a pair of mounting portions 182 on both sides based on the center. The ceiling panel hanger 180 is coupled to the turnbuckle 160 and is disposed in a vertical direction, and the pair of left and right mounting portions 182 are arranged in a horizontal direction.

In the present disclosure, the ceiling panels 120 arranged to be adjacent to each other are mounted on the pair of mounting portions 182 of the ceiling panel hanger 180.

In the present disclosure, the E-bracket 130 is fixedly installed on a lower beam piece 116 of an H beam 110 placed below a slab of a building, so that the E-bracket 130 is installed below the building slab.

The E-bracket 130 includes a vertical connecting bracket piece 132, an upper bracket piece 134 with a base portion coupled to one surface of the connecting bracket piece 132, a middle bracket piece 136, and a lower bracket piece 138 and having an E-shaped cross-section.

The upper bracket piece 134 of the E-bracket 130 is disposed on an upper surface of a lower beam piece 116 of an H beam 110 installed below the building slab, the middle bracket piece 136 is fixed by an upper fixing bolt 136UFB so that the E-bracket 130 is fixedly installed to the H beam 110.

The upper bracket piece 134 of the E-bracket 130 contacts an upper surface of the lower beam piece 116 of the H beam 110, an upper fixing bolt 136UFB is coupled to a bolt 172 hole penetrating upper and lower surfaces of the middle bracket piece 136 of the E-bracket, an upper end portion of the upper fixing bolt 136 UFB is mounted above the middle bracket piece 136 so that the upper fixing bolt 136UFB is pressed on a lower surface of the lower beam piece 116 of the H-beam, thereby stably fixing the E-bracket 130 to the H-beam 110 disposed below the building slab. The connecting bracket piece 132 of the E-bracket 130 is disposed in the vertical direction, and the upper bracket piece 134, the middle bracket piece 136, and the lower bracket piece 138 of the E-bracket 130 are arranged in a horizontal direction.

In addition, a long bolt 140 is coupled to the lower bracket piece 138 of the E-bracket 130, and an upper connecting nut 146 and a lower connecting nut 148 coupled to a threaded portion of an outer circumferential surface of the long bolt 140 are respectively arranged on upper and lower surfaces of the lower bracket piece 138 of the E-bracket 130 so that the long bolt 140 is fixed to the lower bracket piece 138 of the E-bracket 130. In this manner, the long bolt 140 is fixed to the E-bracket 130 and disposed in the vertical direction.

The turnbuckle 160 has a ring shape with a pair of left and right side buckle pieces 166 on an upper buckle piece 162 and a lower buckle piece 164, and the threaded portion of the outer circumferential surface of the long bolt 140 is coupled to a buckle-side bolt 172 hole formed in the upper buckle piece 162 so that the turnbuckle 160 is coupled to the long bolt 140.

In addition, an I-bolt 170 is coupled to the lower buckle piece 164 of the turnbuckle 160. The I-bolt 172 is configured in a shape having a circular bolt-coupling ring at a lower end portion thereof (See FIG. 3).

The ceiling panel hanger 180 is coupled to the I-bolt 170 by the bolt 172 and a nut 174.

The ceiling panel hanger 180 has a shape having a hook for coupling a hanger-side bolt 172 that penetrates through both sides of an upper end portion thereof, and by inserting the bolt 172 into the hook for coupling the hanger-side bolt 172 of the ceiling panel hanger 180 and the hook for coupling the bolt 172 of the I-bolt 172 and fastening the nut 174 to the bolt 172, the ceiling panel hanger 180 is coupled to the I-bolt 170 by the bolt 172 and the nut 174.

In an embodiment of the present disclosure, the E-bracket 130, the long bolt 140, the turnbuckle 160, the I-bolt 172, and the ceiling panel hanger 180 are installed sequentially in the vertical direction from top to bottom below the building slab, and the ceiling panels 120 adjacent to each other are mounted on the pair of left and right mounting portions 182 of the ceiling panel hanger 180. Preferably, caulking is performed between a bottom surface of the ceiling panel 120 and the pair of left and right mounting portions 182 of the ceiling panel hanger 180.

Therefore, the ceiling panel 120 support structure of the present disclosure has the effect of stably installing a plurality of ceiling panels by mounting them below the ceiling slab and has the effect of further improving the mounting structure of the ceiling panel 120. The present disclosure has the effect of reliably providing the ceiling panel 120 support structure that may be stably installed by mounting a plurality of ceiling panels below the ceiling slab.

In particular, by fixing the E-bracket 130 to the H beam 110 placed below the building slab and installing the ceiling panel hanger 180 via the E-bracket 130, a base portion that supports the ceiling panel hanger 180 that supports the ceiling panel 120 mounted thereon is configured as the more solid E-bracket 130, so that the effect of reliably providing the ceiling panel 120 support structure capable of stably installing a plurality of ceiling panels by mounting them may be expected.

Here, as illustrated in FIG. 6, the ceiling panel hanger 180 is further provided with a pair of upper ceiling panel support pieces 183 on the left and right so as to be arranged above the pair of left and right mounting portions 182, so that the pair of left and right mounting portions 182 support the ceiling panel 120 from below, and the upper ceiling panel support piece 183 supports the ceiling panel 120 from above, thereby enabling the ceiling panel 120 to be installed more firmly and stably. In FIG. 5, it is illustrated that the hanger-side hook portion provided on the ceiling panel hanger 180 is installed to be caught by a hook portion provided in a lower end portion of the I-bolt 170.

Meanwhile, in another embodiment of the present disclosure, the long bolt 140 includes an upper long bolt 142 having an upper end coupled to the lower bracket piece 138 of the E-bracket 130 and a lower end to which a pipe hanger 150 is coupled and a lower long bolt 144 coupled to a lower end of the pipe hanger 150, and an upper connecting nut 146 and a lower connecting nut 148 fastened to a threaded portion of an outer circumferential surface of the lower long bolt 144 are respectively arranged on upper and lower surfaces of the lower bracket piece 138 of the E-bracket 130 so that the long bolt 140 is fixed to the lower bracket piece 138 of the E-bracket 130, the buckle-side bolt 172 hole formed in the upper buckle piece 162 of the turnbuckle 160 is coupled to a threaded portion of an outer circumferential surface of the lower long bolt 144 so that the turnbuckle 160 is coupled to the lower long bolt 144.

In another embodiment of the present disclosure, the E-bracket 130, the upper long bolt 142, the pipe hanger 150, the lower long bolt 144, the turnbuckle 160, the I-bolt 172, and the ceiling panel hanger 180 are sequentially installed in the vertical direction from top to bottom below the building slab, and the ceiling panels 120 adjacent to each other are mounted and installed on the pair of left and right mounting portions 182 of the ceiling panel hanger 180.

In another embodiment of the present disclosure, as described above, in the present disclosure, the ceiling panels 120 adjacent to each other are mounted on the pair of mounting portions 182 of the two ceiling panel hangers 180 arranged to be adjacent to each other so as to be installed below the building slab. Preferably, in another embodiment of the present disclosure, caulking is performed between the bottom surface of the ceiling panel 120 and the pair of left and right mounting portions 182 of the ceiling panel hanger 180.

In another embodiment of the present disclosure, by inserting and mounting the pipe 152 in the pipe hanger 150, it is possible to install more pipes 152 for a building required for building construction below the building slab, and it is also possible to expect the effect of stably installing the building pipe 152.

Figure 7:
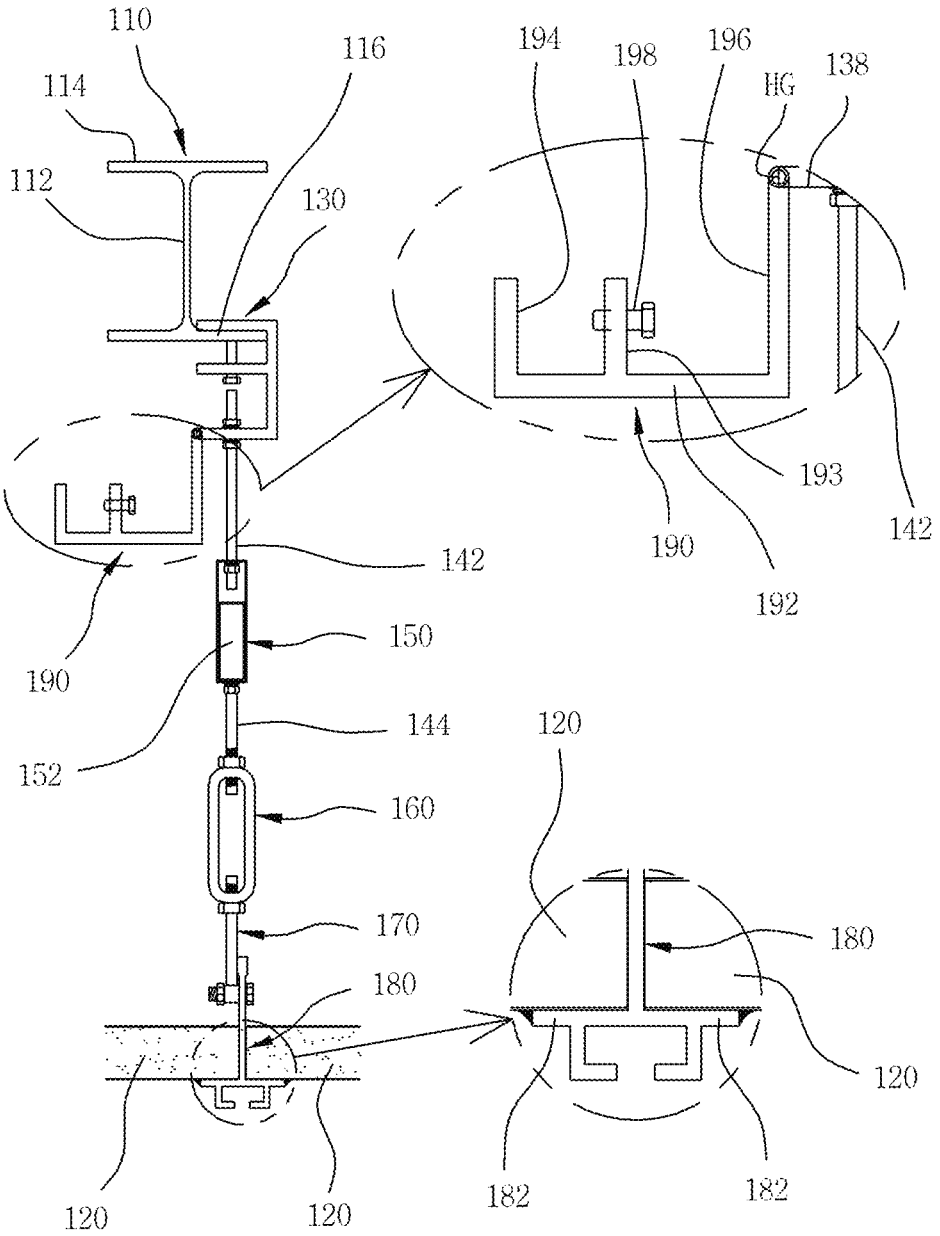
FIG. 7 is a front view schematically illustrating a state in which a ceiling panel is installed and supported by a ceiling panel mounting support structure with an improved mounting structure and a state in which a connecting reinforcement bracket is rotated downward according to another embodiment of the present disclosure.
Figure 8:
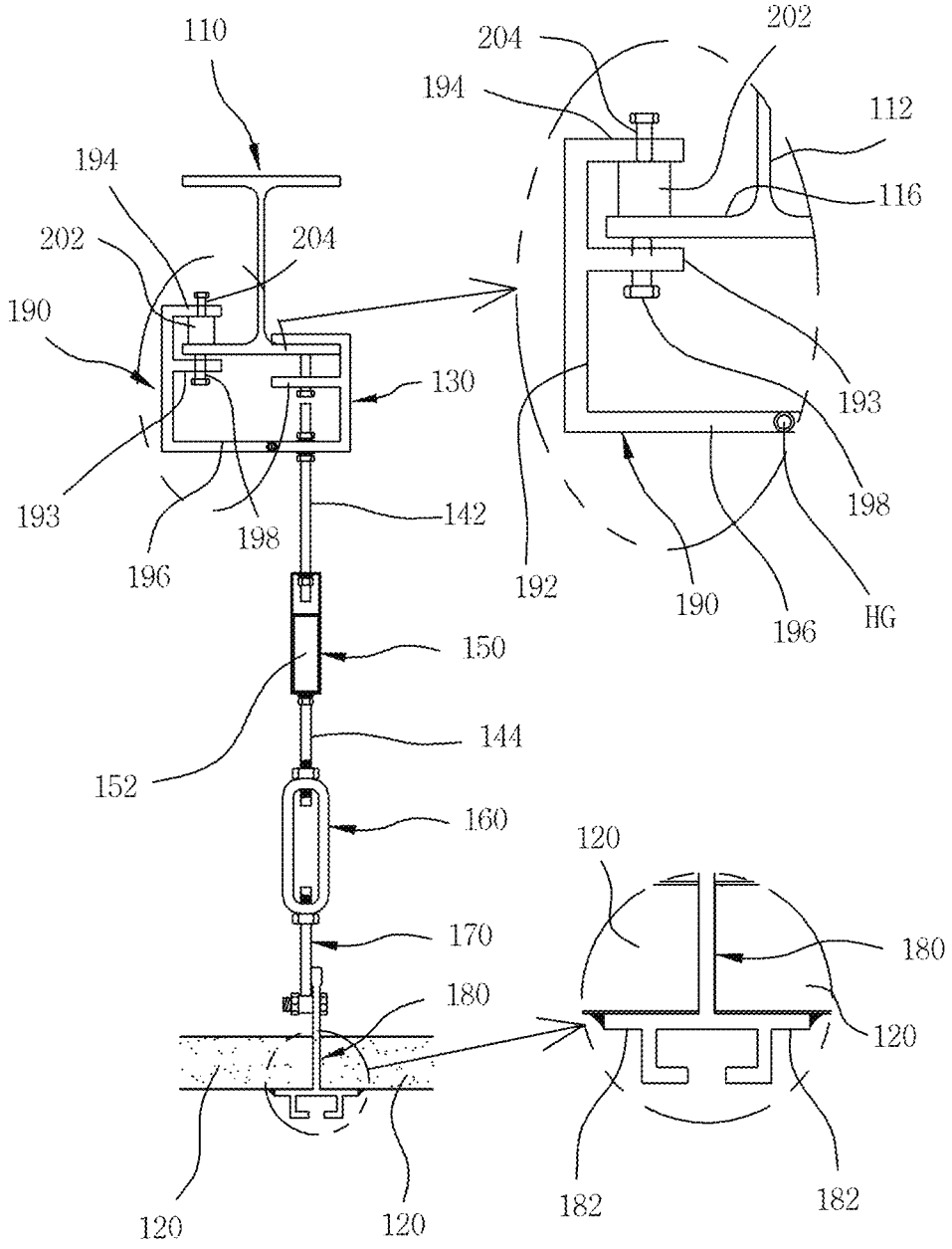
FIG. 8 is a front view illustrating a state in which the connecting reinforcement bracket illustrated in FIG. 7 is coupled to an H beam.
Figure 9:
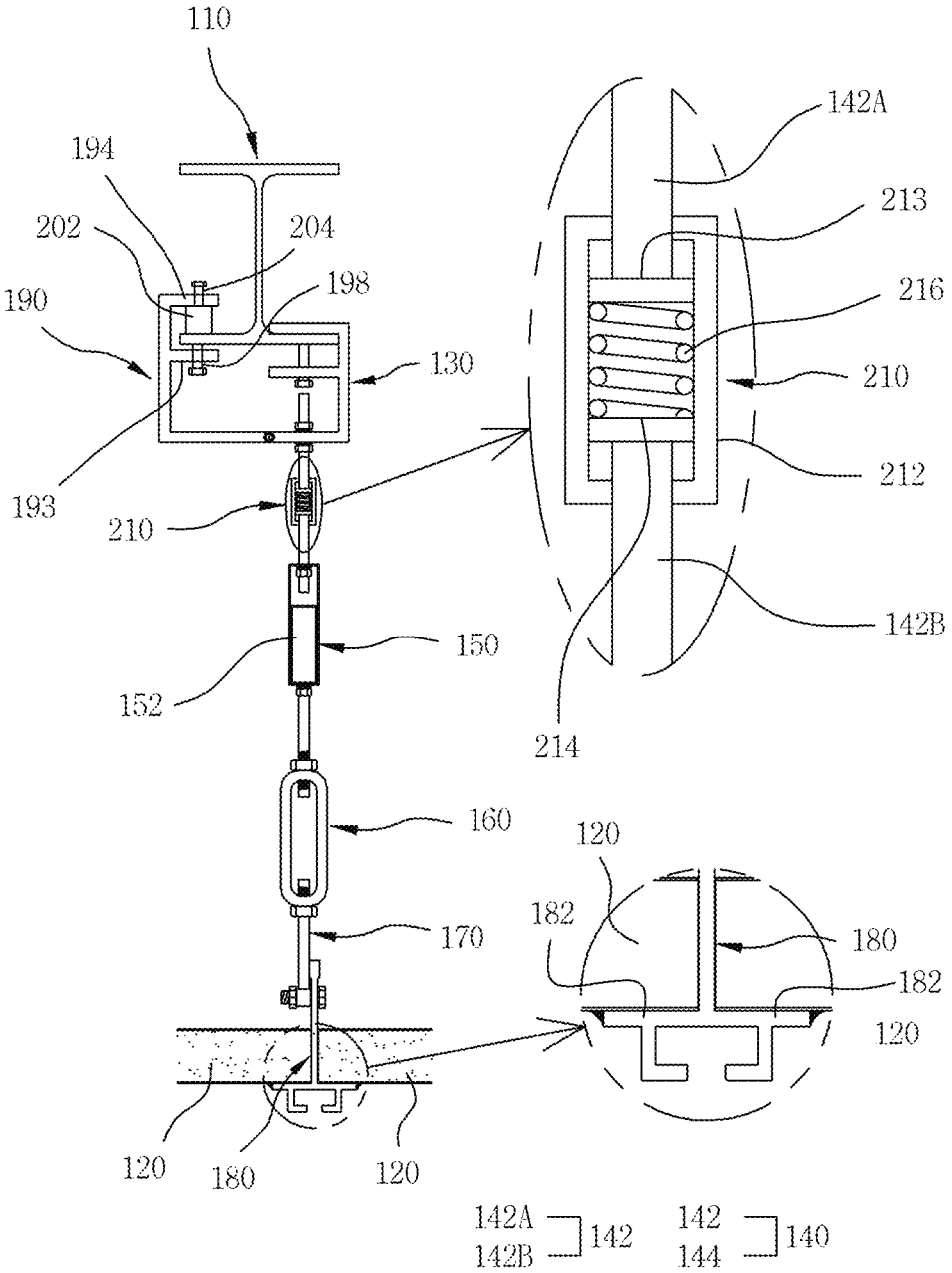
FIG. 9 is a front view illustrating an embodiment in which a seismic connecting support is coupled to a ceiling panel mounting support structure with an improved mounting structure according to the present disclosure.

Meanwhile, FIG. 7 is a front view schematically illustrating a state in which a ceiling panel is installed and supported by a ceiling panel mounting support structure with an improved mounting structure and a state in which a connecting reinforcement bracket is rotated downward according to another embodiment of the present disclosure, FIG. 8 is a front view illustrating a state in which the connecting reinforcement bracket illustrated in FIG. 7 is coupled to an H beam, and FIG. 9 is a front view illustrating an embodiment in which a seismic connecting support is coupled to a ceiling panel mounting support structure with an improved mounting structure according to the present disclosure.

The present disclosure further includes a connecting reinforcement bracket 190, and the connecting reinforcement bracket 190 includes a reinforcement connecting piece 192 connected to the lower bracket piece 138 of the E-bracket 130 via a hinge HG, a cross reinforcement connecting piece 193 connected in a direction perpendicular to the reinforcement connecting piece 192, an upper reinforcement connecting piece 194 connected to an inner surface of the cross reinforcement connecting piece 193 and disposed in a direction parallel to the reinforcement connecting reinforcement connecting piece 196 connected to the inner surface of the cross reinforcement connecting piece 193 so as to be disposed below the upper reinforcement connecting piece 194 and extending in a direction parallel to the upper reinforcement connecting piece 194, and a reinforcement connecting support bolt 198 coupled to the lower reinforcement connecting piece 196 and having an upper end portion that may protrude from one side of the lower reinforcement connecting piece 196 to the other side.

The H beam 110 described in the present disclosure includes an upper beam piece 114 and a lower beam piece 116 at upper and lower end portions of a web 112, respectively. In a state in which the connecting reinforcement bracket 190 is rotated downward based on the hinge at the E-bracket 130 as illustrated in FIG. 7, the connecting reinforcement bracket 190 is rotated upward based on the hinge at the E-bracket 130 as illustrated in FIG. 8. Then, the reinforcement connecting support bolt 198 is tightened in the bolt 172 coupling hole that penetrates the upper and lower surfaces of the cross reinforcement connecting piece 193 of the connecting reinforcement bracket 190 so that the upper end portion of the reinforcement connecting support bolt 198 is pressed to be in close contact with a lower surface of the lower beam piece 116 of the H beam 110. As a result, the connecting reinforcement bracket 190 is stably coupled to the H beam 110 located below the building slab and maintained.

Therefore, in the present disclosure, since the connecting reinforcement bracket 190 is separately fixed to the H-beam 110 on the opposite side of the E-bracket 130 while the E-bracket 130 is fixed to the H-beam 110 below the building slab, the E-bracket 130 may be reliably prevented from escaping from the H-beam, and since the E-bracket 130 is reliably prevented from escaping from the H-beam, the ceiling panel hanger 180 and the ceiling panel 120 may be reliably and stably installed below the building slab.

Meanwhile, as described above, the H beam 110 described in the present disclosure has the upper beam piece 114 and the lower beam piece 116 at the upper and lower end portions of the web 112, respectively. In the present disclosure, a reinforcement support block 202 is interposed between the upper reinforcement connecting piece 194 of the connecting reinforcement bracket 190 and an upper surface of the lower beam piece 116 of the H beam 110, and a block fixing reinforcement bolt 204, which is fastened to the upper reinforcement connecting piece 194 and presses, fixes the reinforcement support block 202 to the upper surface of the lower beam piece 116 of the H beam 110 is further provided.

By further providing this block fixing reinforcement bolt 204, the connecting reinforcement bracket 190 may be stably fixed to the H beam 110 below the building slab without shaking.

In addition, in the present disclosure, the upper long bolt 142 of the long bolt 140 is divided into a first upper long bolt 142A and a second upper long bolt 142B, and an earthquake-resistant connecting support 210 connecting the first upper long bolt 142A and the second upper long bolt 142B is further provided. The earthquake-resistant connecting support 210 includes an earthquake-resistant connecting sleeve 212 in which an upper bolt 172 insertion hole at an upper end portion is slidably coupled to an outer circumferential surface of the first upper long bolt 142A and a lower bolt 172 insertion hole at a lower end portion is slidably coupled to an outer circumferential surface of the second upper long bolt 142B, a first upper hook flange 213 provided at a lower end portion of the first upper long bolt 142A and hooked on an inner surface of an upper end portion of the earthquake-resistant connecting sleeve 212, a second upper hook flange 214 provided at an upper end portion of the second upper long bolt 142B and hooked on an inner surface of a lower end portion of the earthquake-resistant connecting sleeve 212, and an earthquake-resistant spring 216 built into the earthquake-resistant connecting sleeve 212 and having upper and lower end portions connected to the first upper hook flange 213 of the first upper long bolt 142A and the second upper hook flange 214 of the second upper long bolt 142B.

Therefore, when an earthquake occurs, the first upper long bolt 142A and the second upper long bolt 142B are raised relative to the earthquake-resistant connecting sleeve 212 and the earthquake-resistant spring 216 absorbs vibrations due to the earthquake, and thus, the ceiling panel hanger 180 and the ceiling panel 120, which are the main parts installed below the building slab, may be more reliably prevented from being easily shaken by vibrations and being damaged or detached due to the earthquake.

Specific embodiments of the present disclosure have been described. However, the spirit and scope of the present disclosure are not limited to these specific embodiments, and those skilled in the art will understand that various modifications and variations may be made within the scope in which the gist of the present disclosure does not change.

Therefore, these embodiments are provided only to completely disclose the present disclosure and for a person having ordinary skill in the art to which the present disclosure pertains, and therefore, they should be understood to be exemplary and not limiting in all aspects, and the present disclosure is defined only by the scope of the claims.

What is claimed is:

1. A ceiling panel mounting support structure with an improved mounting structure, the ceiling panel mounting support structure comprising:

an E-shaped bracket (130) installed below a slab of a building;

a turnbuckle (160) coupled to the E-shaped bracket (130);

a ceiling panel hanger (180) including a pair of mounting portions (182) on both sides thereof based on a center and coupled to the turnbuckle (160), wherein ceiling panels (120) arranged to be adjacent to each other are mounted on the pair of mounting portion (182) of the ceiling panel hanger (180), wherein the E-shaped bracket (130) includes a vertical connecting bracket piece (132), an upper bracket piece (134) with a base portion coupled to one surface of the connecting bracket piece (132), a middle bracket piece (136), and a lower bracket piece (138) and having an E-shaped cross-section, the upper bracket piece (134) of the E-shaped bracket (130) is disposed on an upper surface of a lower beam piece (116) of an H-beam (110) installed below the building slab, the middle bracket piece (136) is fixed by an upper fixing bolt (136UFB) so that the E-shaped bracket (130) is fixedly installed to the H-beam (110), a long bolt (140) is coupled to the lower bracket piece (138) of the E-shaped bracket (130), and an upper connecting nut (146) and a lower connecting nut (148) coupled to a threaded portion of an outer circumferential surface of the long bolt (140) are respectively arranged on upper and lower surfaces of the lower bracket piece (138) of the E-shaped bracket (130) so that the long bolt (140) is fixed to the lower bracket piece (138) of the E-shaped bracket (130), the turnbuckle (160) has a ring shape with a pair of left and right side buckle pieces (166) on an upper buckle piece (162) and a lower buckle piece (164), and the threaded portion of the outer circumferential surface of the long bolt (140) is coupled to a buckle-side bolt (172) hole formed in the upper buckle piece (162) so that the turnbuckle (160) is coupled to the long bolt (140), an I-bolt (170) is coupled to the lower buckle piece (164) of the turnbuckle (160), and the ceiling panel hanger (180) is coupled to the I-bolt (170) by the bolt (172) and a nut (174); and a connecting reinforcement bracket (190), wherein the connecting reinforcement bracket (190) includes a reinforcement connecting piece (192) connected to the lower bracket piece (138) of the E-shaped bracket (130) via a hinge (HG), a cross reinforcement connecting piece (193) connected in a direction perpendicular to the reinforcement connecting piece (192), an upper reinforcement connecting piece (194) connected to an inner surface of the cross reinforcement connecting piece (193) and disposed in a direction parallel to the reinforcement connecting piece (192), a lower reinforcement connecting piece (196) connected to the inner surface of the cross reinforcement connecting piece (193) so as to be disposed below the upper reinforcement connecting piece (194) and extending in a direction parallel to the upper reinforcement connecting piece (194), and a reinforcement connecting support bolt (198) coupled to the lower reinforcement connecting piece (196) and having an upper end portion configured to protrude from a first side of the lower reinforcement connecting piece (196) to a second side thereof.

2. The ceiling panel mounting support structure of claim 1, wherein the long bolt (140) includes an upper long bolt (142) having an upper end coupled to the lower bracket piece (138) of the E-shaped bracket (130) and a lower end to which a pipe hanger (150) is coupled and a lower long bolt (144) coupled to a lower end of the pipe hanger (150), and an upper connecting nut (146) and a lower connecting nut (148) fastened to a threaded portion of an outer circumferential surface of the lower long bolt (144) are respectively arranged on upper and lower surfaces of the lower bracket piece (138) of the E-shaped bracket (130) so that the long bolt (140) is fixed to the lower bracket piece (138) of the E-shaped bracket (130), the buckle-side bolt (172) hole formed in the upper buckle piece (162) of the turnbuckle (160) is coupled to a threaded portion of an outer circumferential surface of the lower long bolt (144) so that the turnbuckle (160) is coupled to the lower long bolt (144), and the ceiling panels (120) are installed by mounting the ceiling panels (120) adjacent to each other on a pair of the mounting portions (182) of the ceiling panel hanger (180).

* * * * *